US005661994A

United States Patent [19]

Sundquist

[11] Patent Number: 5,661,994

[45] Date of Patent: Sep. 2, 1997

[54] TUBE SHAPING APPARATUS

[76] Inventor: Kevin E. Sundquist, P.O. Box 212, R.R. 3, Dallas, S. Dak. 57529

[21] Appl. No.: 532,996

[22] Filed: Sep. 25, 1995

[51] Int. Cl.[6] ..... B21D 9/05

[52] U.S. Cl. ..... 72/389.6; 72/455; 72/461; 72/389.1

[58] Field of Search ..... 72/389.1, 389.6, 72/389.7, 461, 455

[56] References Cited

U.S. PATENT DOCUMENTS

| | | | |
|---|---|---|---|
| 4,088,002 | 5/1978 | Andrew | 72/455 |
| 4,510,789 | 4/1985 | Tomioka et al. | 72/461 |
| 4,561,281 | 12/1985 | Tran et al. | 72/461 |
| 4,583,390 | 4/1986 | Behrens | 72/455 |
| 4,782,686 | 11/1988 | Carson, Jr. | 72/389.7 |

FOREIGN PATENT DOCUMENTS

| | | | |
|---|---|---|---|
| 499220 | 11/1955 | Italy | 72/389.1 |

*Primary Examiner*—David Jones
*Assistant Examiner*—John Paradiso
*Attorney, Agent, or Firm*—David A. Lingbeck

[57] ABSTRACT

A tube shaping apparatus includes a movable frame having an upper portion mounted upon stanchions, an upper and lower tube engaging member mounted upon the frame for holding a tube therebetween, a tube engagement hydraulic cylinder for urging the upper tube engaging member toward and away from the lower tube engaging member, a tube bending die slidably mounted substantially parallel to the upper portion of the frame, and a pair of tube bending hydraulic cylinders for urging the tube bending die along a horizontal plane for bending and shaping a tube held between the upper and lower tube engaging members. The tube bending die is essentially a tongue-like member having an arcuate forward end which effects the bends in the tubes.

9 Claims, 6 Drawing Sheets

TUBE SHAPING APPARATUS

BACKGROUND OF THE INVENTION

This invention relates to a tube shaping apparatus which holds preferably an elongate tube and bends and shapes the tube to the desired specifications, depending upon the purpose or function for which the tube is going to be used.

When metallic tubes are formed or manufactured, they are generally straight tubes having many different cross-sectional shapes, some having square cross sections, and others having circular cross sections for example. These straight tubes are shaped and bent to form such things as elbows commonly used in the water lines in homes and even as bumpers which encircle a particular type of vehicle to protect the body of the vehicle. There are many other uses for elongate tubes which are bent anywhere along the length of the tube to produce the desired, useful shape. To bend and shape such a tube, the tube as shown by the prior art was generally placed inside of another tube or pipe and as the pipe or shaping tube was bent, the to-be-shaped tube took on the shape of the shaping tube. The prior art also describes apparatuses which hold a generally medial portion of the tube and then urges the ends of the tube in a particular direction by pushing or pulling means to get the desired bend in the tube. Further, the prior art describes bending or shaping tubes by placing a semi-softened plastic tube in a mold or die which takes on a particular bend or curvature.

One known prior art is a METHOD AND APPARATUS FOR BENDING PIPE, U.S. Pat. No. 2,609,859, issued on Sep. 9, 1952 and invented by F. A. Fichtmueller.

Another known prior art is an APPARATUS FOR MANUFACTURING SHAPED ARTICLES OF PLASTICS MATERIAL, PARTICULARLY FILLING PIPES FOR FUEL TANKS OF MOTOR VEHICLES, U.S. Pat. No. 4,747,768, issued on May 31, 1988 and invented by Giuseppe Crupi, comprises a mold having a cavity with the mold being substantially straight but capable of being deformed to effect a particular shape to the cavity which shapes the tube received in the cavity.

Another known prior art is a HAND OPERATED BENDING APPARATUS AND METHOD FOR METAL BAR, TUBING AND THE LIKE, U.S. Pat. No. 4,282,7.37, issued on Aug. 11, 1981 and invented by Billy G. Maples, comprises a sweep lever arm, a forming die, and preset pivoted force link with the sweep lever arm applying force to a tube or a bar so that the tube or bar follows the shape of the die.

While there are many different ways to bend tubes or pipes, none of the prior art describes using a hydraulic-controlled engaging means to generally hold the tubes or pipes in place while a bending die is used to bend and shape the tubes or pipes.

SUMMARY OF THE INVENTION

The present invention relates to a tube shaping apparatus which comprises a movable frame mounted upon casters or wheels for easy and convenient moving of the tube shaping apparatus, a bending die means for bending and shaping the tube, and a tube engagement means including a pair of planar tube engaging members for generally holding the tube in place as the bending die bends the tube to the desired specifications.

One objective of the present invention is to provide a tube shaping apparatus which generally holds or engages much of the surface are of the tube so that the tube moves only with the tube bending die resulting in exact bends.

Another objective of the present invention is to provide a tube shaping apparatus which can bend any length or size of tube easily and conveniently.

Also, another objective of the present invention is to provide a tube shaping apparatus which allows the user to quickly bend or shape many tubes within a very short period of time because the tubes are simply held between the two planar tube engaging members by means of hydraulic cylinders.

Yet, another objective of the present invention is to provide a tube shaping apparatus which holds the tubes in place by engaging across much of the surface of the tubes.

Further objectives and advantages of the present invention will become apparent as the description proceeds and when taken in conjunction with the accompanying drawings wherein:

DETAILED DESCRIPTION OF THE INVENTION

Figure 1:
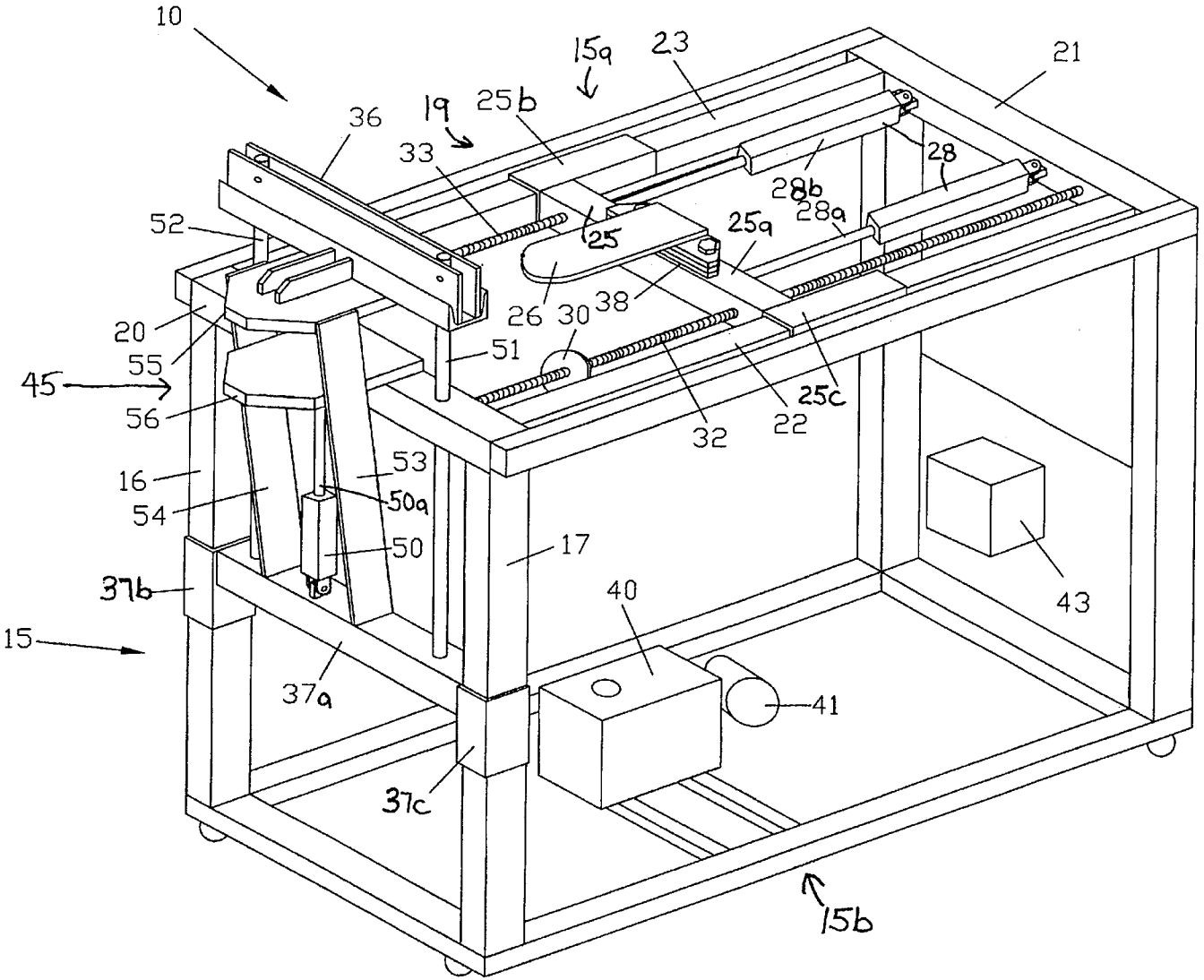
FIG. 1 is a top perspective view of the tube shaping apparatus
Figure 2:
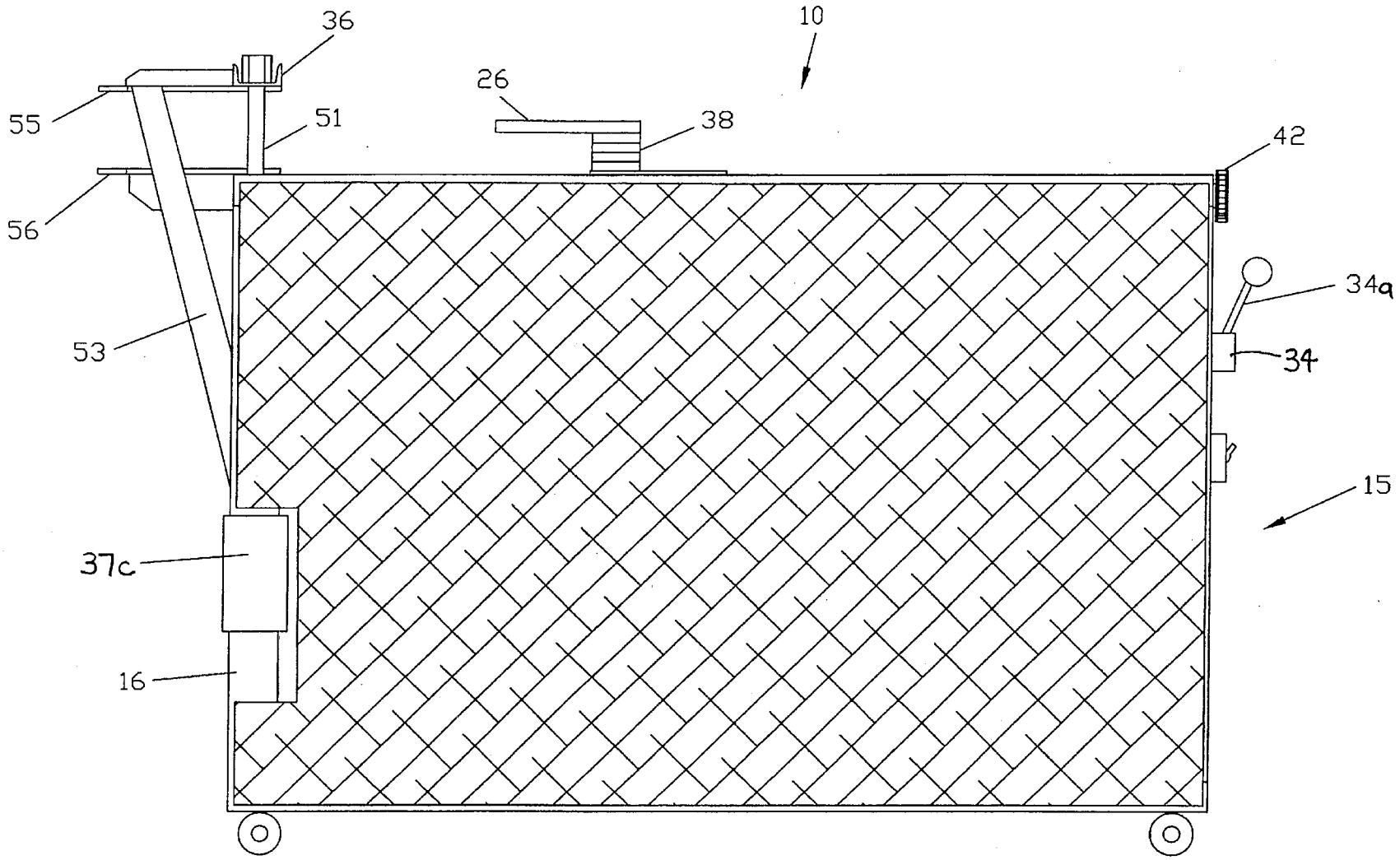
FIG. 2 is a side elevation view of the tube shaping apparatus.
Figure 3:
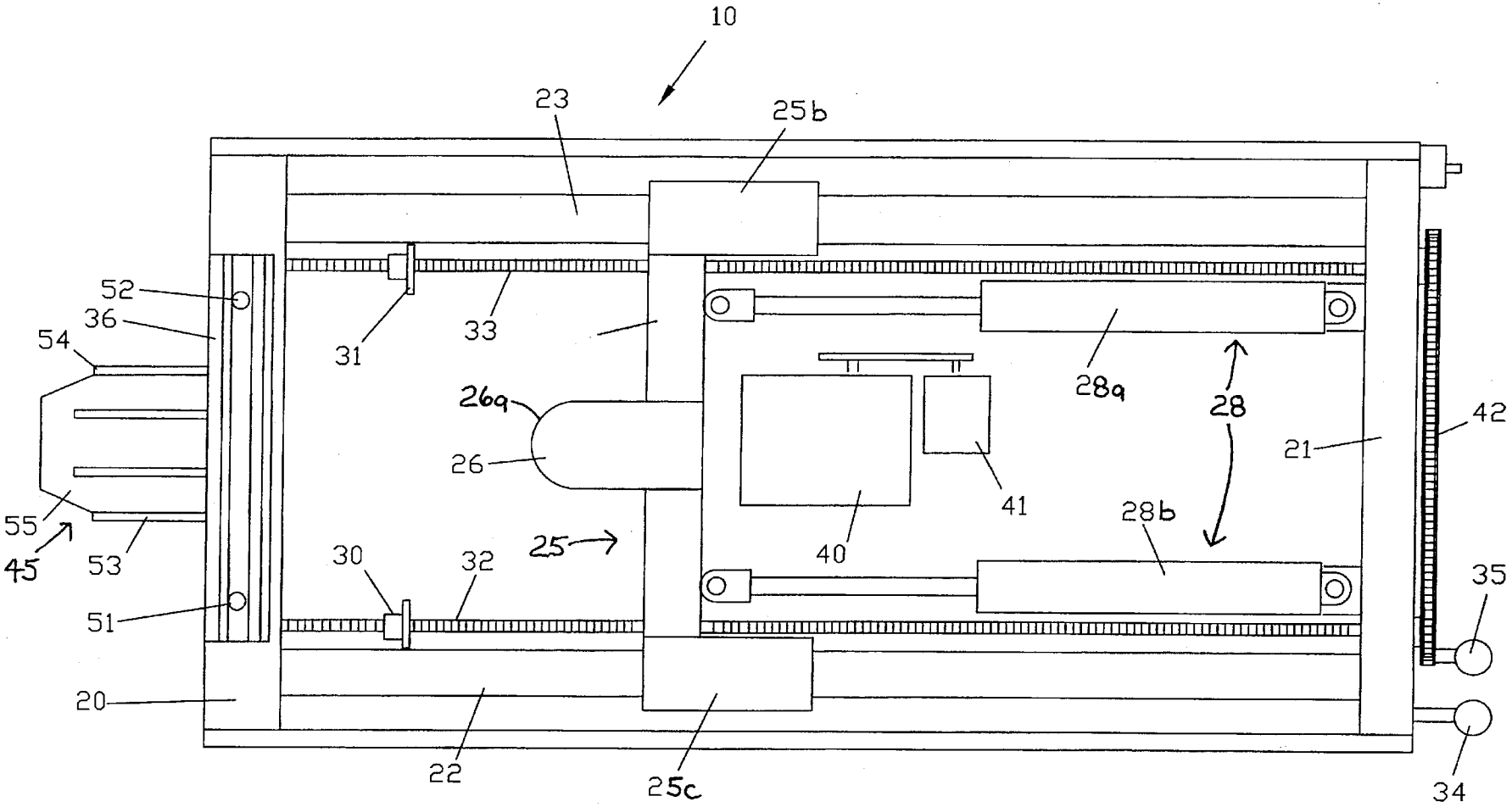
FIG. 3 is a top plan view of the tube shaping apparatus.

Referring to the drawings in FIGS. 1 in particular, the tube shaping apparatus 10 comprises a frame 15 mounted upon wheels or casters and having a lower portion **15*b* comprising a pair of elongate end members interconnecting a pair of elongate longitudinal members all of which are disposed generally horizontally, and further having an upper portion 15*a* comprising a first and second elongate end members 20,21 interconnecting a pair of elongate longitudinal members all of which are also disposed generally horizontally with the upper portion 15*a* being interconnected to the lower portion 15*b* by a plurality of stanchions 16,17 fixedly attached to where the end members 20,21 adjoin the longitudinal members. As shown in FIGS. 1 & 3, the upper portion 15*a* of the frame 15 supports a tube bending means 19 which comprises a pair of rails 22,23 having ends fixedly attached to the elongate end members 20,21 of the upper portion 15*a* of the frame 15 and being disposed between the longitudinal members of the upper portion 15*a* of the frame 15 with each rail 22,23 being adjacent to and separated from a respective one of the longitudinal members. The tube bending means also comprises a tube bending die 26 which is essentially a planar tongue-like member 26 having an arcuate forward end 26*a* and which is fastened with bolts upon a medial portion of a bending die carrier means 25 which includes an elongate bending die Support member 25*a* Which has ends fixedly attached to a pair of slide portions 25*b*,25*c* each of which is slidably mounted upon a respective one of the rails 22,23 for sliding the tube bending die 26 back and forth thereupon. The tongue-like tube bending die 26 is generally disposed above and parallel to a plane within which the upper portion 15*a* of the frame 15 is disposed, and extends forward of the bending die support member 25*a* and has its arcuate forward end 26*a* directed toward the first elongate end member 20 of the upper portion 15***a* of the frame 15 and is generally separated from the bending die support member 25*a* by at least one spacer 38 which is used to raise or lower the tube bending die 26 relative to the bending die support member 25*a* to effect the desired bends in the tubes having different thicknesses.

Figure 4:
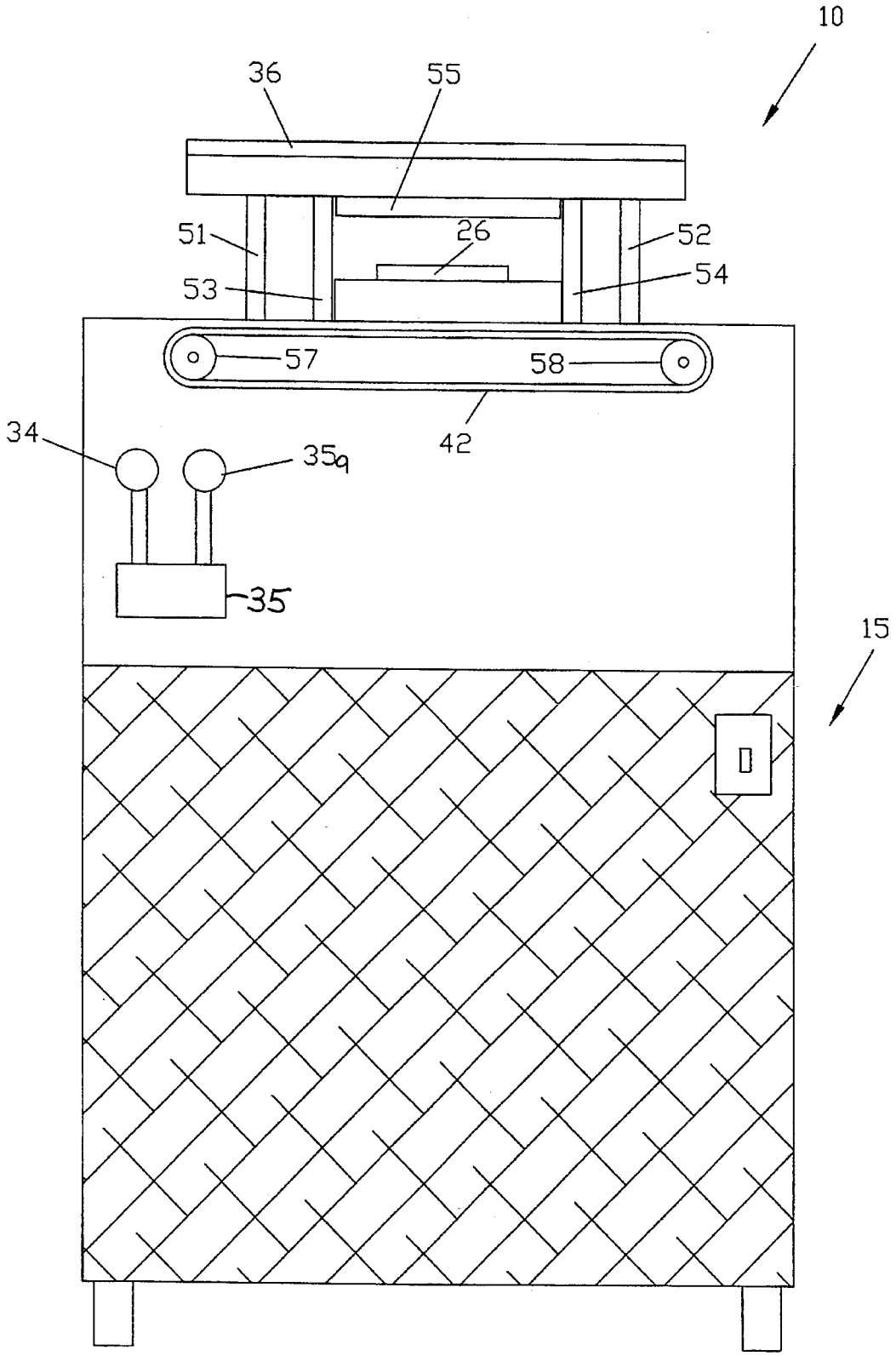
FIG. 4 is an end elevation view of the tube shaping apparatus with end panels on the frame.
Figure 5:
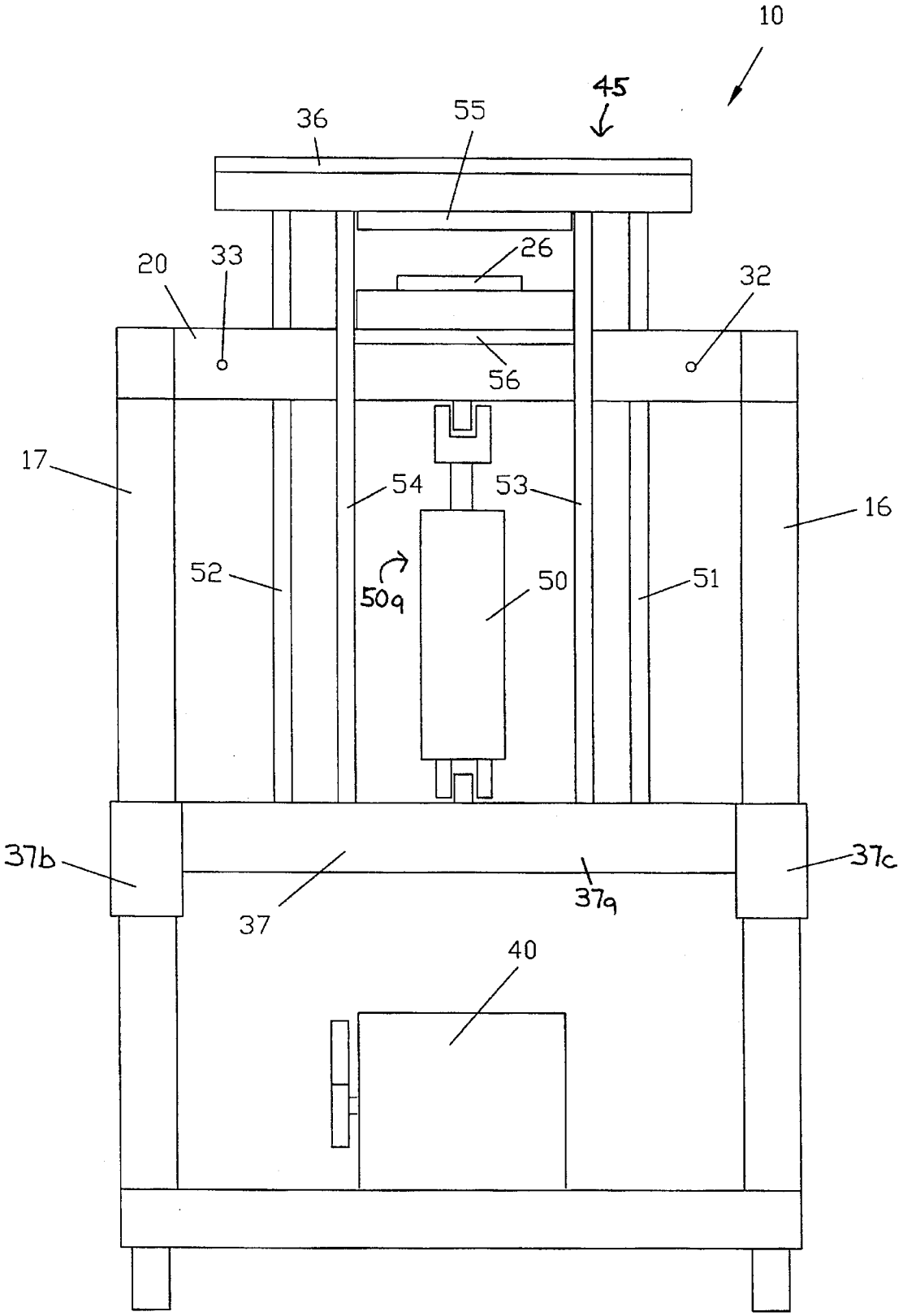
FIG. 5 is an end elevation view of the tube shaping apparatus with the end panels removed from the frame.
Figure 6:
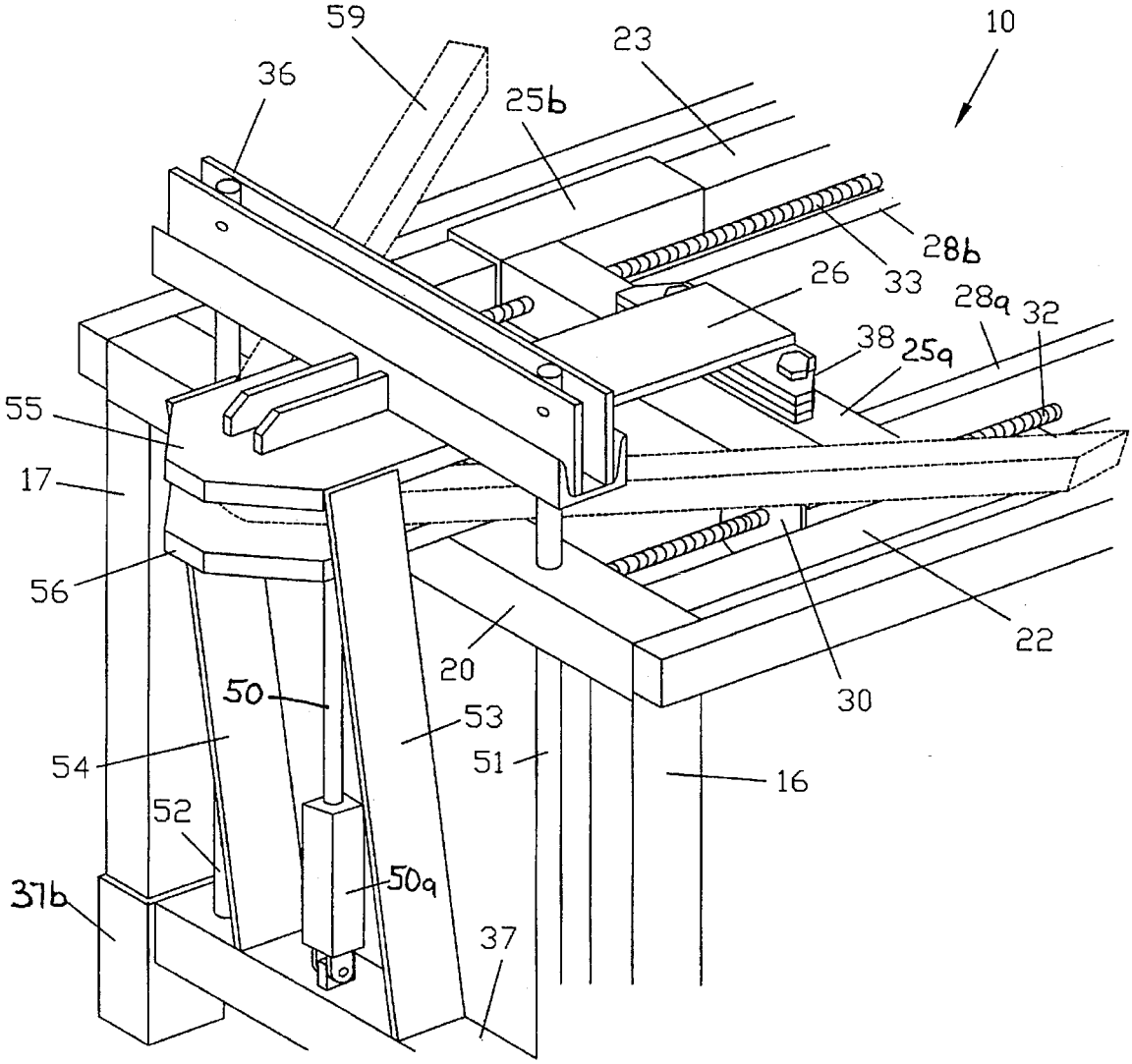
FIG. 6 is a detailed perspective view of the tube engagement means of the tube shaping apparatus.

As further shown in FIGS. 1 & 3, a tube bending actuator means 28 which includes a pair of bending hydraulic cylinders 28*a*,28*b* is used to move the tube bending die 26 in a plane generally parallel to the plane of the upper portion 15*a* of the frame 15. Each of the bending hydraulic cylinders 28*a*,28*b* has one end fastened to a side of the bending die support member 25*a* and has its other end fastened to a side of the second elongate end member 21 of the upper portion 15*a* of the frame 15. The bending hydraulic cylinders 28*a*,28*b* have fittings which are Connected to pipes which are connected to a tube bending control means 34 which includes a lever 34*a* and a valve means and is connected to a hose which is connected to a pump 40 mounted upon the lower portion 15*b* of the frame 15 and connected to a hydraulic fluid reservoir 41 and a motor which energizes the pump 40 which pumps hydraulic fluid from the reservoir 41 through the hoses and pipes to the bending hydraulic cylinders 28*a*,28*b* which moves the tube bending die 26 back and forth upon the rails 22,23. The lever 34*a* opens and closes the valve means which controls the flow of hydraulic fluid through the pipes. The lever 34*a* moves the valve means to open the passage through one of the pipes and closes the passage through another of the pipes, and vice versa when the lever 34*a* is manipulated. A user can control which direction the tube bending die 26 moves by directing and controlling the flow of the hydraulic fluid through the pipes. The tube bending die 26 can move only so far toward the first elongate end member 20 before it is stopped by a pair of adjustable stop members 30,31 which are threaded upon a pair of elongate stop member supports 32,33 which have ends extending through the two elongate end members 20,21 of the upper portion 15*a* of the frame 15. The elongate stop member supports 32,33 extend through the bending die support member 25*a* which is movable along much of the length of the two elongate stop member supports 32,33. The stop members 30,31 function much like abutments against which the bending die support member 25*a* abuts when the tube bending die 26 is urged toward the first end member 20 of the upper portion 15*a* of the frame 15. The two elongate stop member supports 32,33 are adjacent and close enough to the two rails 22,23 such that the two stop member 30,31 are engaged to the two rails 22,23. The two stop members 30,31 are movable along much of the length of the two elongate stop member supports 32,33 by turning the two elongate stop member supports 32,33 clockwise or counter clockwise. As shown in FIG. 4, two sprocket 57,58 each of which is attached to near an end of a respective one of the elongate stop member supports 32,33 and in cooperation with each other, carries an endless member 42 such as a chain which is used to adjust the stop members 30,31 equally without the worry that one stop member 30,31 will be adjusted more or less than the other stop member 30,31 thus disrupting the consistency and integrity of bending each and every tube. The user can simply move the endless flexible member 42 in either direction which turns the sprockets 57,58 which turns the two elongate stop member supports 32,33 which thread itself in or out of the two stop members 30,31 which do not turn. It is important to set both stop members 30,31 the same so that the same bend will be made in every tube being bent with the stop members 30,31 being set at a particular position.

The tube to be bent or shaped is preferably a straight tube which is placed upon the upper portion 15*a* of the frame 15 and securely held in place by a tube engagement means 45 which is shown in FIGS. 1,2,5 & 6 and which comprises a planar lower tube engaging member 56 fixedly attached upon the first elongate end member 20, and further comprises a movable planar upper tube engaging member 55 which is mounted to a pair of support arms 53,54 each of which has an end fixedly attached to an edge of the upper tube engaging member 55 and has another end which is fixedly attached upon a top side of a carrier means 37 which includes an elongate support member 37*a* such as a tubular member having ends fixedly attached to a pair of sleeve-like portions 37*b*,37*c* each of which is slidably mounted about a respective one of the stanchions 16,17 for vertical movement along thereof.

A brace 36 is fixedly attached to the top side of the upper tube engaging member 55 and is connected to a pair of elongate brace supports 51,52 each of which has one end fastened to a respective end portion of the brace 36 and has its other end fixedly attached or welded to the top side of the elongate support member 37*a* which extends laterally between the two stanchions 16,17. The elongate brace supports 51,52 slidably extend through the first elongate end member 20 of the upper portion 15*a* of the frame 15*b*. A tube engagement actuator means 50 which includes a tube engagement hydraulic cylinder 50*a* has one end fastened to the top side of the elongate support member 37*a* and the other end fastened to the underside of the first elongate end member 20 of the upper portion 15*a* of the frame 15 and further has fittings connected to pipes which are connected to a tube engagement control means 35 which includes a lever 35*a* and a valve means and is further connected to the hose which is connected to the pump 41 which when energized pumps hydraulic fluid through the hose and pipes to the tube engagement hydraulic cylinder 50 which moves the upper tube engaging member 55 toward and away from the lower tube engaging member 56 which is essentially in vertical alignment with the upper tube engaging member 55.

In operation, a tube is placed laterally upon the upper portion 15*a* of the frame 15 with the tube extending outward beyond the two longitudinal members of the upper portion 15*a* of the frame 15 and resting against the two elongate brace supports 51,51 and upon the lower tube engagement member 56. The user clamps the tube in place by moving the control lever 35*a* to allow hydraulic fluid to flow into the hydraulic cylinder which urges the upper planar engagement member 55 downward toward the lower engagement member 56 until it comes into engagement with the tube which is now securely engaged between the upper and lower engagement members 55,56. To bend or shape the tube, the user then moves the control lever 34*a* for the bending, control means 34 to allow hydraulic fluid to flow into the two hydraulic cylinders 28*a*,28*b* which urges the tube bending die 26 toward the tube. The stop members 30,31 control the extent of the bend into tube by stopping the tube bending die 26. The bending die support member 25*a* comes into contact with the stop members 30,31 and the tube bending die 26 is stopped. The stop members 30,31 can be adjusted to allow the tube bending die 26 to bend the tube either more or less. Once the tube is bent, the user moves the control levers 34*a*,35*a* for both the bending means and the engagement means so that the hydraulic fluid flows into the hydraulic cylinders 50*a*,28*a*,28*b* which urge the upper tube engagement member 55 upward away from the lower tube engagement member 56 and which urge the tube bending die 26 away from the tube so that the bent tube can be removed.

One tube after another can be quickly and conveniently bent and shaped using this tube shaping apparatus 10.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A tube shaping apparatus comprising, a movable frame having plurality of stanchions and an upper portion mounted upon said stanchions;

a tube engagement means mounted upon said movable frame for holding a respective tube to be bent, said tube engagement means including a lower tube engaging member fixedly mounted upon said upper portion of said frame and a means for holding the respective tube upon said lower tube engaging member, said tube holding means further including a carrier means slidably mounted upon a pair of said stanchions, a tube engagement actuator means mounted upon said carrier means for moving said carrier means upon said stanchions, an upper tube engaging member for movement toward and away from said lower tube engagement member, and a means for supporting and mounting said upper tube engaging member upon said carrier means; and a tube bending means mounted upon said movable frame for bending and shaping the respective tube.

2. A tube shaping apparatus as described in claim 1, wherein said carrier means comprises an elongate support member extending laterally between said pair of stanchions and having sleeve-like portions attached at the ends of said elongate support member, said sleeve-like portions slidably mounted about said stanchions for vertical movement thereupon.

3. A tube shaping apparatus as described in claim 1, wherein said means for supporting and mounting said upper tube engaging member includes a brace fixedly attached to said upper tube engaging member; a pair of elongate brace supports attached to said brace and to said carrier means; and a pair of support arms attached to said upper tube engaging member and to said carrier means.

4. A tube shaping apparatus as described in claim 1, wherein said tube engagement actuator means is a hydraulic cylinder having one end Connected to said carrier means and the other end connected to said upper portion of said frame for vertically moving said carrier means.

5. A tube shaping apparatus as described in claim 4, wherein said tube engagement actuator means further includes a tube engagement control means for energizing said hydraulic cylinder with hydraulic fluid from an energy source.

6. A tube shaping apparatus as described in claim 1, wherein said upper tube engaging member is disposed above said lower tube engaging member.

7. A tube shaping apparatus as described in claim 6, wherein said upper tube engaging member is generally in vertical alignment with said lower tube engaging member, said upper tube engaging member in cooperation with said lower tube engaging member being adapted to engage a tube therebetween.

8. A tube shaping apparatus comprising, a movable frame having a plurality of stanchions and an upper portion mounted upon said stanchions;

a tube engagement means mounted upon said movable frame for holding a respective tube to be bent; and a tube bending means mounted upon said movable frame for bending and shaping the respective tube, said tube bending means comprising a pair of spaced apart rails fixedly attached to said upper portion of said frame; a bending die carrier means slidably mounted upon said rails and including an elongate bending die support member; a tube bending die mounted upon said bending die carrier means for bending and shaping the respective tube, said tube bending die being essentially a tongue-like member having an arcuate forward end for effecting the bend and shape of the respective tube; a stop means to restrict the sliding of said bending die carrier means; and a tube bending actuator means for moving said bending die carrier means back and forth along said rails.

9. A tube shaping apparatus as described in claim 8, wherein said tube bending die is mounted upon said elongate bending die support member such that said tube bending die extends forward of said elongate bending die support member.

* * * * *